US009687798B2

(12) United States Patent
Hoefken

(10) Patent No.: US 9,687,798 B2
(45) Date of Patent: Jun. 27, 2017

(54) HORIZONTAL AGITATOR

(71) Applicant: INVENT UMWELT-UND VERFAHRENSTECHNIK AG, Erlangen (DE)

(72) Inventor: Marcus Hoefken, Erlangen (DE)

(73) Assignee: INVENT UMWELT-UND VERFAHRENSTECHNIK AG, Erlangen (DE)

( * ) Notice: Subject to any disclaimer, the term of this patent is extended or adjusted under 35 U.S.C. 154(b) by 120 days.

(21) Appl. No.: 14/389,792

(22) PCT Filed: Mar. 20, 2013

(86) PCT No.: PCT/EP2013/055837
§ 371 (c)(1),
(2) Date: Oct. 1, 2014

(87) PCT Pub. No.: WO2013/149833
PCT Pub. Date: Oct. 10, 2013

(65) Prior Publication Data

US 2015/0078121 A1 Mar. 19, 2015

(30) Foreign Application Priority Data

Apr. 4, 2012 (DE) ..... 10 2012 205 577

(51) Int. Cl.
*B01F 7/06* (2006.01)
*B01F 7/00* (2006.01)

(52) U.S. Cl.
CPC ..... *B01F 7/06* (2013.01); *B01F 7/00741* (2013.01); *B01F 7/063* (2013.01); *B01F 2215/0422* (2013.01)

(58) Field of Classification Search
CPC ..... B01F 7/00733; B01F 7/00741
See application file for complete search history.

(56) References Cited

U.S. PATENT DOCUMENTS 4,566,801 A 1/1986 Salzman
8,210,738 B2 7/2012 Hoefken
(Continued)

FOREIGN PATENT DOCUMENTS

DE 102007008135 A1 4/1974
DE 19501414 A1 7/1996
(Continued)

OTHER PUBLICATIONS

PCT, "International Preliminary Report on Patentability for International Application No. PCT/EP2013/055837."
(Continued)

*Primary Examiner* — Tony G Soohoo
*Assistant Examiner* — Elizabeth Insler
(74) *Attorney, Agent, or Firm* — Manabu Kanesaka

(57) ABSTRACT

The invention relates to a horizontal agitator for producing a flow in a clarifier, a propeller being connected to a submersible motor which is axially offset in relation thereto, wherein the propeller and the submersible motor are designed such that a flow in a direction from the propeller towards the submersible motor is produced when the submersible motor is operated, and wherein plate-shaped flow guide elements are provided downstream of the propeller and extend in at least an axial plane that runs substantially parallel to the propeller axis. In order to improve the efficiency of the horizontal agitator, it is proposed in accordance with the invention to support the submersible motor on a bottom of the clarifier via at least two first flow guide elements.

7 Claims, 3 Drawing Sheets

(56) References Cited

U.S. PATENT DOCUMENTS

Figure 2:
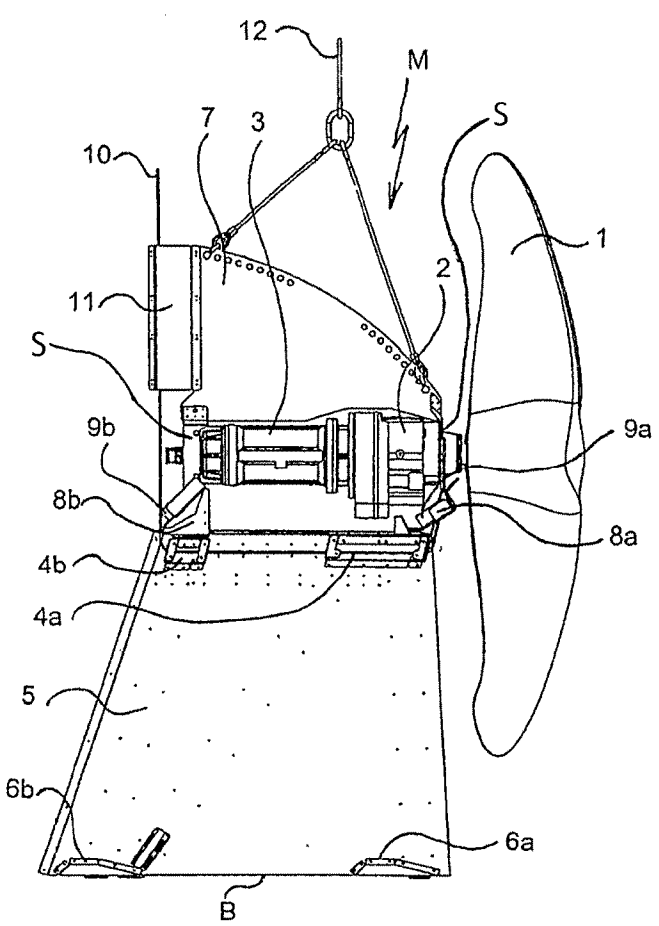

| | | | | |
|---|---|---|---|---|
| 2010/0066089 | A1* | 3/2010 | Best | F03B 3/06 290/52 |
| 2010/0133174 | A1* | 6/2010 | Hoefken | B01F 7/0005 210/512.3 |

FOREIGN PATENT DOCUMENTS

| | | | |
|---|---|---|---|
| DE | 19620986 | C1 | 9/1997 |
| WO | 2008/101632 | A1 | 8/2008 |
| WO | 2008/101633 | A1 | 8/2008 |

OTHER PUBLICATIONS

PCT, "International Search Report for International Application No. PCT/EP2013/055837".

* cited by examiner

HORIZONTAL AGITATOR

The invention relates to a horizontal agitator for producing a flow in a clarifier according to the preamble of Patent claim 1.

Such a horizontal agitator is known from WO 2008/101633 A1. The known horizontal agitator is received on a slide, which is movable vertically along a pillar-like frame. With the known horizontal agitator it is possible to produce a horizontal flow directed in the direction of the frame with a good level of efficiency. Nevertheless, there is the need to further improve the efficiency of the production of the horizontal flow.

The object of the invention is to overcome the disadvantages according to the prior art. In particular, a horizontal agitator is to be specified that enables the production of a horizontal flow with further improved efficiency.

This object is achieved by the features of claim 1. Expedient embodiments of the invention will emerge from the features of claims 1 to 7.

In accordance with the invention it is proposed for the submersible motor to be supported on a bottom of the clarifier via at least two first flow guide elements. Since two first flow guide elements are now used to support the submersible motor, it is possible to dispense with the frame known in accordance with the prior art for supporting the submersible motor.

As a result, the flow resistance caused by the frame is omitted. The proposed horizontal agitator enables a particularly efficient production of a horizontal flow. In addition, it can be produced easily and cost-effectively. The term "axial plane" is understood to mean a plane that contains the substantially horizontally running axis of the propeller.

In accordance with an advantageous embodiment, the first flow guide elements are interconnected via at least one carrier plate receiving the submersible motor. The first flow guide elements each extend from the carrier plate at an angle from 90° to 140°, preferably 100° to 120°. In particular if the flow guide elements extend such that they point away from one another at an angle of more than 90° from the carrier plate, a particularly stable support of the submersible motor can be achieved.

In accordance with a further advantageous embodiment, the first flow guide elements and/or the at least one carrier plate is/are produced from folded sheet metal. In particular, it has proven to be advantageous to form the first flow guide elements and/or the at least one carrier plate in a double-walled manner from folded sheet metal. In the case of a double-walled design, apertures for avoiding air pockets within the double wall are provided in at least one of the walls of the double wall.

In accordance with a further embodiment, the first flow guide elements are interconnected on the bottom side via at least one connection element. The at least one carrier plate, the first flow guide elements extending therefrom and the at least one connection element thus form a tunnel-like structure, which is particularly stable.

In accordance with a further embodiment, a second flow guide element is provided, which extends in a direction pointing away from the bottom of the clarifier from a supporting structure installed on the carrier plate or from the submersible motor. The provision of the second flow guide element contributes to an improved orientation of the horizontal flow.

In accordance with a particularly advantageous embodiment, the carrier plate with the first flow guide element installed thereon forms a mount, on which an assembly unit formed from the submersible motor and the propeller is detachably fastened by means of a coupling device. The assembly unit expediently also comprises the second flow guide element. The detachable fastening of the assembly unit on the mount enables a particularly simple maintenance and/or repair of the assembly unit. The assembly unit can be detached from the mount for example by means of a cable winch and can then be raised into a position above a level of wastewater received in the clarifier.

Figure 1:
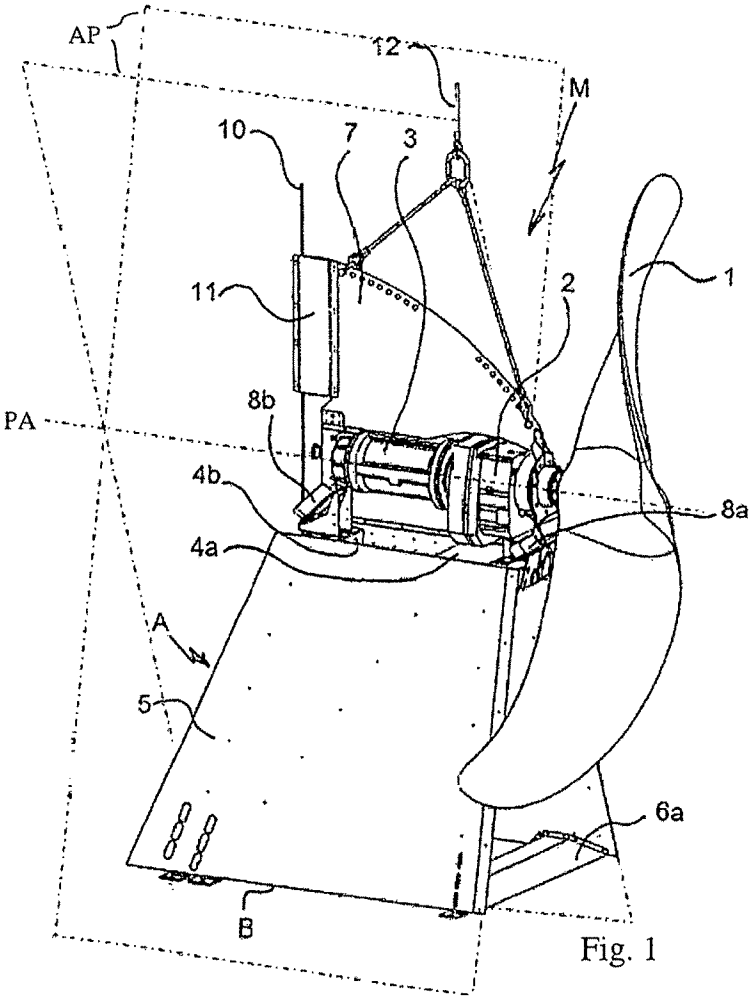
Figure 4:
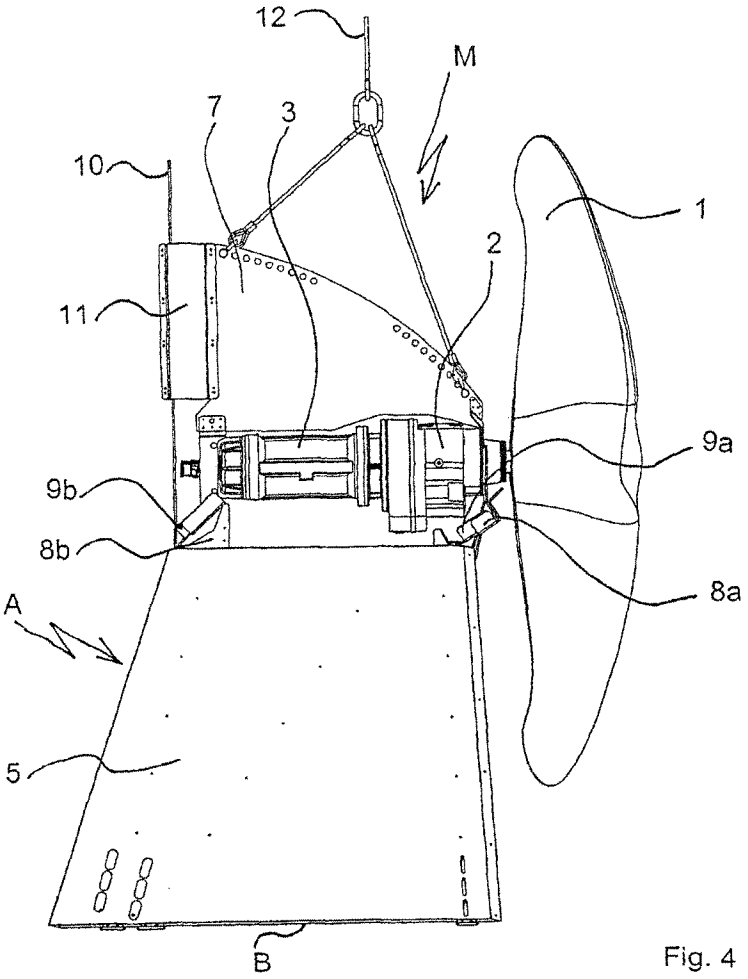
Figure 3:
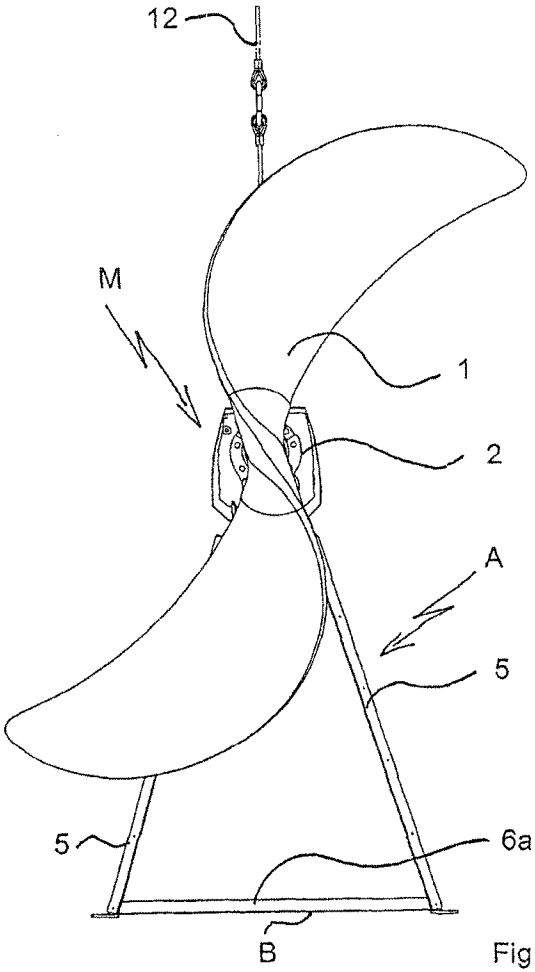
Figure 6:
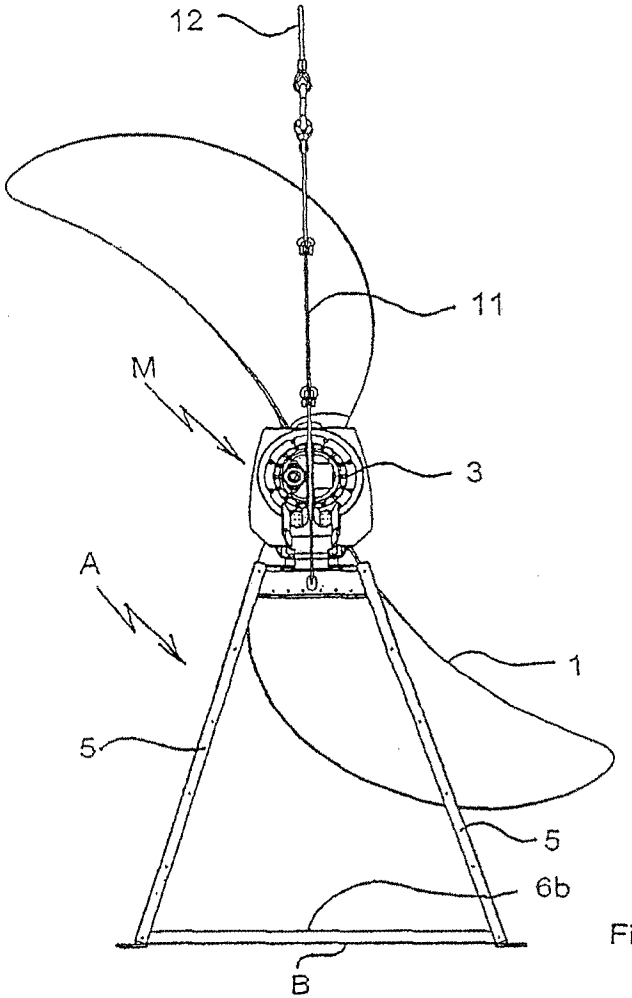
Figure 5:
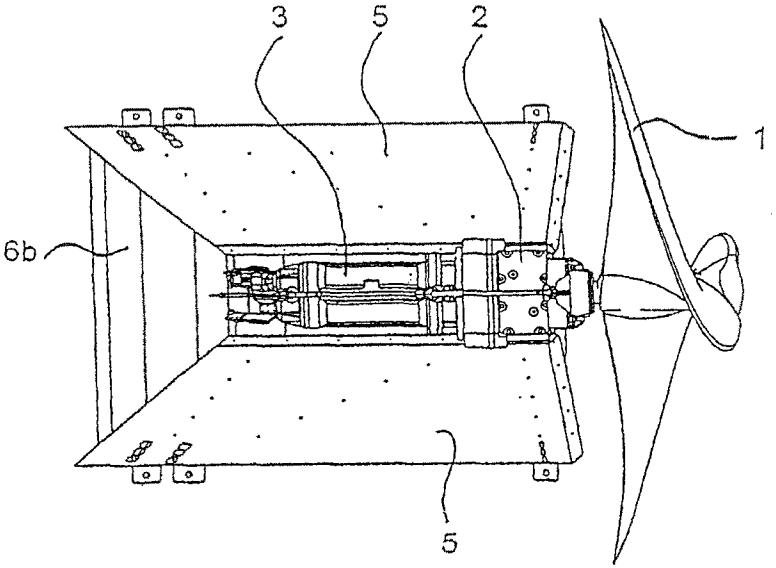

An exemplary embodiment of the invention will be explained in greater detail hereinafter on the basis of the drawings, in which:

FIG. 1 shows a perspective view of the horizontal agitator,
FIG. 2 shows a sectional view according to FIG. 1,
FIG. 3 shows a front view according to FIG. 1,
FIG. 4 shows a side view according to FIG. 1,
FIG. 5 shows a plan view according to FIG. 1 and
FIG. 6 shows a rear view according to FIG. 1.

With the horizontal agitator shown in the figures, a propeller 1 is connected via a gearing 2 to a submersible motor 3. The submersible motor 3 is operated in such a way that a flow directed from the propeller 1 to the submersible motor 3 is produced.

Plate-shaped flow guide elements 5, 7 are provided downstream of the propeller 1 and extend in an axial plane (AP) running substantially parallel to the propeller axis (PA).

The propeller 1, together with the submersible motor 3 and any provided gearing 2, forms an assembly unit that is supported on a front carrier plate 4*a* and a rear carrier plate 4*b*. First flow guide elements 5 extend from both the front carrier plate 4*a* and rear carrier plate 4*b* at an angle from approximately 100° to 120°. The first flow guide elements 5 are formed in a plate-like manner. The planes thereof run approximately parallel to an axis of the propeller 1.

The front carrier plate 4*a* and the rear carrier plate 4*b* and the first flow guide elements 5 are advantageously produced from folded sheet metals. To improve the stability, the carrier plates 4*a*, 4*b* and/or the flow guide elements 5 are double-walled. Here, the folded sheet metals are expediently connected by means of rivets. A mount A produced in this way has excellent stability.

In the region of the bottom B of the clarifier, the first flow guide elements 5 are expediently connected to a front connection element 6*a* and a rear connection element 6*b*. The front connection element 6*a* and the rear connection element 6*b* each have a flat incident-flow face and downstream a steeply sloping flow-off face.

The assembly unit denoted by reference sign M has a second flow guide element 7, which extends vertically above the submersible motor 3 and has a curved incident-flow edge.

The assembly unit M is detachably connected to a mount A, which comprises the carrier plates 4*a*, 4*b*, the first flow guide elements 5 extending therefrom and the connection elements 6*a*, 6*b*. To detachably connect the assembly unit M to the mount A, a first coupling element 8*a* and a second coupling element 8*b* are installed on the front carrier plate 4*a* and on the rear carrier plate 4*b*. A third coupling element 9*a* corresponding to the first coupling element 8*a* and a fourth coupling element 9*b* corresponding to the second coupling element 8*b* are installed on the mounting element M.

Reference sign 10 denotes a cable. A guide 11, preferably a slotted guide, by means of which the assembly element M is guided along the cable 10, extends from the second flow guide element 7.

To lift the assembly unit M, a further cable 12 can be fixed at the assembly unit M. By exerting a tensile stress by means of the further cable 12, a coupling between the mount A and the assembly element M caused by the coupling elements 8*a*, 8*b*, 9*a*, 9*b* can be detached, and the assembly element M can be guided along the cable 10 and lifted from the clarifier.

As can be seen from FIG. 2, one end of the cable 10 can be guided through the rear carrier plate 4*b* and the front carrier plate 4*a* and fastened to the assembly unit M in the region of the third coupling element 9*a*. The other end of the cable 10 can be guided via a pulley (not shown here) fixed above the clarifier and fastened at the fastening point. The cable 10 can thus form a cable winch together with the further cable 12, by means of which the assembly unit M is guided when lowered in the direction of the mount A and can be coupled there by cooperation of the coupling elements 8*a*, 8*b*, 9*a*, 9*b*.

Also, second flow guide element 7 extends in a direction pointing away from the bottom of the clarifier from a support structure (S) installed on front carrier plate 4*a* and rear carrier plate 4*b* or from the submersible motor 3.

LIST OF REFERENCE SIGNS

1 propeller
2 gearing
3 submersible motor
4*a* first carrier plate
4*b* second carrier plate
5 first flow guide element
6*a* first connection element
6*b* second connection element
7 second flow guide element
8*a* first coupling element
8*b* second coupling element
9*a* third coupling element
9*b* fourth coupling element
10 cable
11 guide element
12 further cable
A mount
B bottom
M assembly unit

The invention claimed is:

1. A horizontal agitator for producing a flow in a clarifier, comprising:

a propeller connected to a submersible motor which is axially offset in relation thereto; and plate-shaped flow guide elements provided in downstream of the propeller, each of the plate-shaped flow guide elements extending in an axial plane thereof running substantially parallel to a propeller axis, wherein the propeller and the submersible motor are designed such that a flow in a direction from the propeller towards the submersible motor and through the plate-shaped flow guide elements is produced when the submersible motor is operated, the submersible motor is supported on a bottom of the clarifier via at least two first flow guide elements, the first flow guide elements are interconnected via at least one carrier plate receiving the submersible motor, the first flow guide elements extend from the carrier plate such that the first flow guide elements point away from each other at an angle of more than 90°, and the carrier plate with the first flow guide elements installed thereon forms a mount, on which an assembly unit formed from the submersible motor and the propeller is detachably fastened by a coupling device.

2. The horizontal agitator according to claim 1, wherein the first flow guide elements each extend from the carrier plate such that the first flow guide elements point away from each other at the angle from 100° to 120°.

3. The horizontal agitator according to claim 1, wherein the first flow guide elements and/or the at least one carrier plate are produced from edged sheet metal.

4. The horizontal agitator according to claim 1, wherein the first flow guide elements are interconnected on a bottom side via at least one connection element.

5. The horizontal agitator according to claim 1, wherein a second flow guide element is provided, which extends in a direction pointing away from the bottom of the clarifier from a support structure installed on the carrier plate or from the submersible motor.

6. The horizontal agitator according to claim 5, wherein the submersible motor is located between the first flow guide elements and the second flow guide element.

7. The horizontal agitator according to claim 1, wherein a water flow from the propeller towards the submersible motor and a water flow from the propeller through the plate-shaped flow guide elements are parallel to each other.

* * * * *